United States Patent [19]

Andrews

[11] 4,032,142

[45] June 28, 1977

[54] PRACTICE TENNIS RACKET

[76] Inventor: Robert M. Andrews, 3100-80th NE., Bellevue, Wash. 98004

[22] Filed: Sept. 12, 1975

[21] Appl. No.: 612,934

[52] U.S. Cl. ..... 273/29 A; 273/73 R

[51] Int. Cl.[2] ..... A63B 61/00

[58] Field of Search ..... 273/29 R, 29 A, 26 R, 273/26 B, 73 R, 73 D, 73 L, 96 R; 43/7, 14

[56] References Cited

UNITED STATES PATENTS

| | | | |
|---|---|---|---|
| 1,458,335 | 6/1923 | Glichikoff | 273/96 R |
| 1,558,507 | 10/1925 | Ryder | 273/73 L |
| 2,025,995 | 12/1935 | Lerch | 273/96 R |
| 2,738,976 | 3/1956 | Vallieries | 273/73 R |

FOREIGN PATENTS OR APPLICATIONS

| | | |
|---|---|---|
| 761,257 | 3/1934 | France |
| 1,301,373 | 4/1902 | France |
| 422,495 | 1/1935 | United Kingdom |
| 891,047 | 12/1959 | United Kingdom |

*Primary Examiner*—Richard C. Pinkham
*Assistant Examiner*—T. Brown
*Attorney, Agent, or Firm*—Robert B. Hughes

[57] ABSTRACT

A practice tennis racket having a handle and peripheral frame corresponding to a conventional tennis racket. Extending across the frame is a flexible barrier net and a gridwork of yielding retaining strings. When a tennis ball is struck with the racket, the retaining strings permit the ball to pass therethrough to be caught in the net, with the strings retaining the ball in the net.

13 Claims, 8 Drawing Figures

PRACTICE TENNIS RACKET

BACKGROUND OF THE INVENTION

1. Field of the Invention

The present invention relates to a practice racket especially adapted for practice of a tennis service, as well as other tennis strokes, and also for warm-up exercises.

2. Description of the Prior Art

One of the more difficult maneuvers to execute in a tennis game is an effective service. In serving the tennis ball, the ball is tossed a moderate distance above the player's head, and the player swings the racket in an overhead arc to impact the ball as the racket is traveling through the uppermost portion of the arc. The usual method of practicing a service is to actually serve the ball on a conventional tennis court or against a wall or other barrier spaced some distance away from the server. Unfortunately, a tennis court may not always be available, or when available a number of balls must be used and chased after each serve, or when a barrier is used there is often not sufficient room to engage in such practice. Thus, quite often the only alternative is for the player to simply swing his racket through the serving motion. However, this does not permit the player to coordinate the tossing up of the ball and striking the ball as a continuous serving motion.

In the prior art there are a number of practice rackets for a variety of purposes. For example, U.S. Pat. No. 3,503,611, McPherson, shows a practice racket in which the strings of the racket are removed and a pouch is mounted over the racket frame. This pouch has a central ball port through which the tennis ball can enter into the interior of the pouch, and also a double bottom at the backside of the pouch to receive the impact of the tennis ball. When the racket is swung at the ball in a manner that the ball passes through the entry port, the ball is then retained in the pouch for a subsequent stroke. One of the problems with this device is that for the pouch to properly perform its retaining function, the entry port must be made sufficiently small so that there is little margin for error in the player's serving motion. In other words, if the server strikes the ball at a location spaced moderately from the center area of the racket, the ball is not able to pass through the entry port, and is thus propelled away from the server. Furthermore, the pouch material and construction presents a different weight and stroke air resistence when compared to a conventional tennis racket.

U.S. Pat. No. 1,540,823, Mairhofen, illustrates a ball catching device mounted to a racket where there are two plates having retaining teeth thereon. When a ball strikes the area between the plates, these two plates close on the ball with the teeth causing the ball to be retained in the racket. This apparatus also requires that the ball be impacted at a precise location quite close to the centerline of the racket. Unlike the present invention, this device is designed to be used in a new game and not for the practice of conventional tennis.

U.S. Pat. No. 2,738,976, Vallieres, and also British Patent Specification No. 2042, Greenham, having an acceptance date of May 22, 1902, disclose rackets having cords for retaining stationary tennis balls, shoes or the like when the racket is not being used. U.S. Pat. No. 1,364,331, Vaile, discloses a tennis racket in which the impact strings are made somewhat looser than usual to permit a game similar to tennis to be played with a dead ball in an area of smaller dimensions than the conventional tennis court. U.S. Pat. No. 2,080,642, Timpe, shows a racket having resilient rubber strings and edge mounting, the intended purpose of which is to provide greater resiliency in play and to improve the durability of the racket.

U.S. Pat. No. 3,078,099, Hyman, illustrates a combined ball paddle and catching receptacle. One surface of the paddle is used to strike the ball, while the other side of the paddle has a semirigid woven material in the general configuration of a basket. When the ball strikes the basket, it becomes enmeshed therein so as to be retained by the woven material.

U.S. Pat. No. 3,206,195, Myers, shows a baseball batting aid comprising a handle and a peripheral frame to which is attached a net. The particular purpose of this batting aid is to teach the user to properly position his wrists during the batting stroke. If the peripheral frame is properly positioned during the stroke, and if the ball is engaged within the area of the peripheral frame, the ball enters the net and is retained thereby. Also representative of the prior art are U.S. Pat. No. 2,025,995 and U.S. Pat. No. 3,845,953.

While the prior art known to the applicant does permit a ball to be engaged and retained by a racket in a variety of ways, there still remains a need for a practice racket that closely resembles the configuration, weight and handling characteristics of a conventional tennis racket by which a tennis stroke, particularly a tennis service stroke, can be practiced in a manner to closely simulate an actual game stroke or service and allow the ball to be struck anywhere on the playing surface from different angles such as is experienced in actual play to accommodate the entire range of player ability, while retaining the ball in the racket so that such practice can be conducted in a relatively confined area. Thus, it is an object of the present invention to fulfill such a need.

SUMMARY OF THE INVENTION

The present invention is a practice racket for a game such as tennis, by which a player can execute a stroke against a game ball in a manner similar to a stroke executed with a conventional game racket, while retaining the ball in the practice racket. In the preferred form, the practice racket has the over all configuration of a conventional tennis racket and comprises a handle adapted to be grasped by the player to execute the practice stroke, and a peripheral frame attached to the handle. This frame defines an impact area in the plane occupied by the frame, this impact area corresponding to the area of a game racket where the ball is normally struck in actual game play. Attached to the peripheral frame and extending across the impact area is a flexible net means which is sufficiently large in area relative to the impact area, so that the net means can deflect at least moderately from the plane of the impact area upon engaging the ball. Also connected to the frame and extending across the impact area is a string retaining means. The string retaining means is sufficiently yielding to permit the ball to pass therethrough into the net means, and yet has sufficient tension to retain the ball in the net after the ball has passed through the string means.

In the preferred form of the present invention, the string means comprises a plurality of strings arranged in a grid. As shown herein, one set of strings is parallel to the longitudinal axis of the racket, and a second set of strings is transverse to the longitudinal axis. Thus, the strings that form the grid separate the impact area of the racket into a plurality of impact zones arranged in a rectangular pattern. Desirably the strings are positioned on both sides of the retaining net. when the racket is swung at the ball, the ball passes through the retaining strings into one of the impact zones and is retained by the combination of the net and the retaining strings in that particular zone. This permits the player to determine at what part of the impact area the ball was engaged so that the player can ascertain if he is striking the ball correctly.

In the actual construction of the particular embodiment shown herein, a conventional tennis racket was used. The strings of the racket were removed; an auxiliary mounting frame was positioned and secured within the conventional racket frame; and the retaining strings and net were mounted to the auxiliary mounting frame. This particular arrangement is well adapted for construction of a single racket or a small number of rackets with readily available components. It is to be understood, however, that for large scale production it is likely that certain changes in structural details, configuration and/or materials would be desirable, and it is intended that these be considered within the scope of the present invention.

DESCRIPTION OF THE PREFERRED EMBODIMENT

The preferred embodiment of the present invention shown in the accompanying drawing is a practice tennis racket 10 particularly adapted for practice of a tennis service. However, it should be understood that the broader aspects of the present invention are not confined to this particular use or precise physical arrangement.

Figure 1:
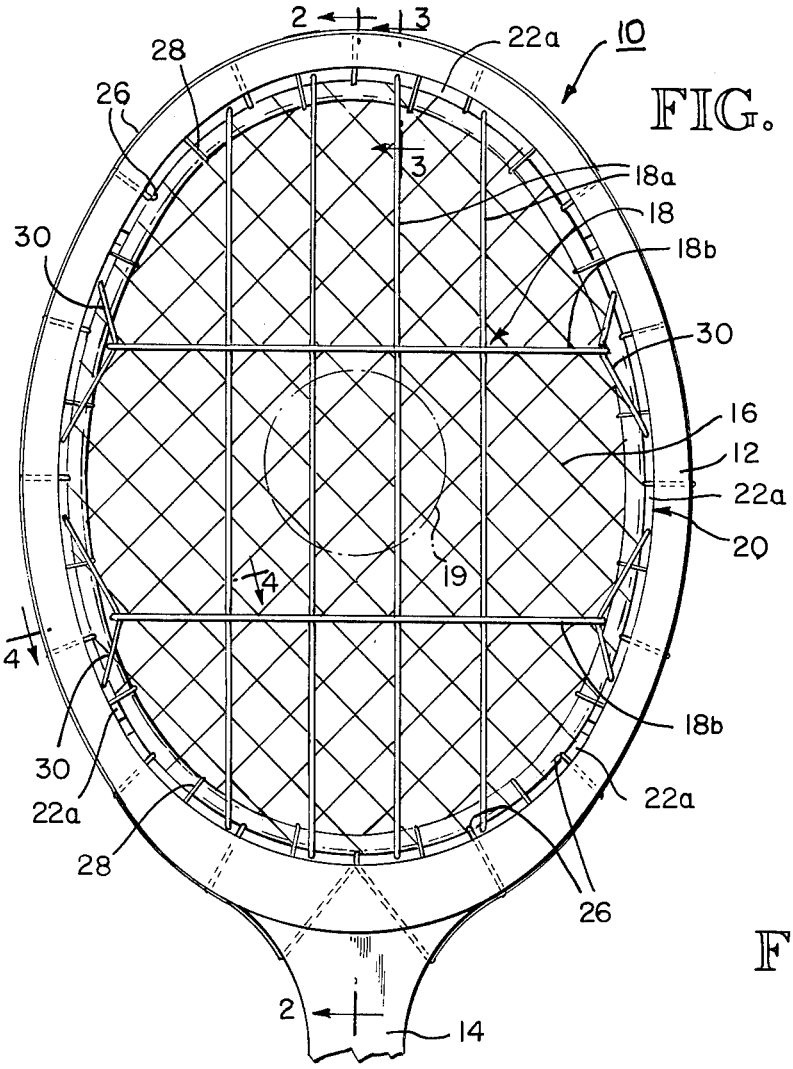
FIG. 1 is a view taken from a position in front of the frame of the practice racket of the present invention.
Figure 2:
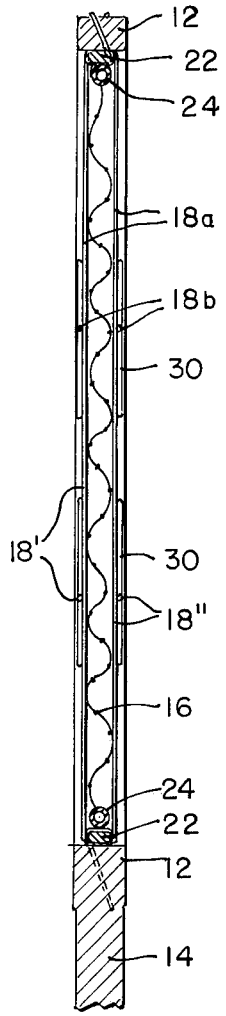
FIG. 2 is a sectional view through the longitudinal center line of the racket, taken along line 2—2 of FIG. 1.
Figure 4:
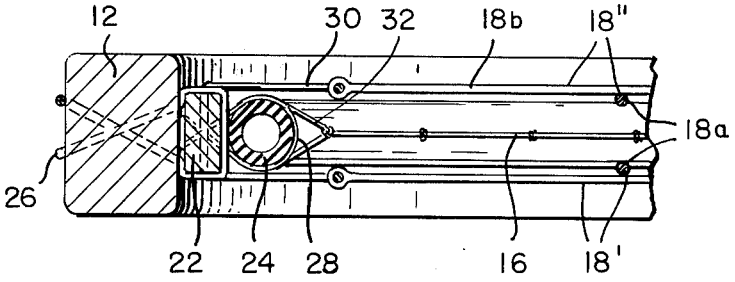
FIG. 4 is a view similar to FIG. 3, taken along line 4—4 of FIG. 1.
Figure 3:
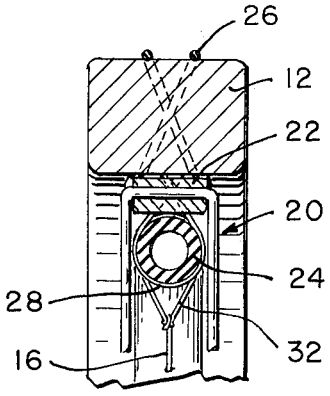
FIG. 3 is a sectional view taken along line 3—3 of FIG. 1, and illustrating a portion of the auxiliary mounting frame.

The racket 10 has the overall configuration of a conventional tennis racket, and thus comprises a generally oval frame 12 and an elongate handle 14. (For convenience of illustration, only a portion of the handle 14 is shown in FIG. 1.) By having the dimensions, weight and balance of the racket 10 being substantially the same as or at least very close to that of an actual game racket which the player uses, the serving motion employing the practice racket will more closely simulate the serving motion in actual game play. This practice racket 10 can be made quite conveniently through a modification of a conventional tennis racket, by removing the existing strings that are connected in a grid-like pattern across the frame 12 and substituting the components of the present invention.

In describing this racket 10, the longitudinal axis shall be considered coincident with the lengthwise axis of the handle 14, and the transverse axis is considered perpendicular to the longitudinal axis and lying in the plane of the frame 12. The term "lower" denotes proximity to the terminal end of the handle 14, and the term "upper" denotes proximity to the opposite end of the racket 10, i.e. near the end of the frame opposite the handle. The term "inner" or "inside" denotes proximity to the center area of the frame 12. The term "forward" denotes the face of the racket which is traveling towards the ball, and the term "rearward" quite obviously denotes the opposite face of the racket 10.

In this practice racket 10, the two main fucntional components are a flexible barrier net 16 and a retaining string means 18. The barrier net 16 reaches across the area within the perimeter of the frame 12, this area being the impact area where a game ball is normally struck with the racket. As its name implies, this barrier net 16 functions to engage the ball, indicated at 19, and prevent it from passing through the racket 10.

The retaining string means 18 also extends across the impact area of the racket 10. As shown herein, there are two sets of retaining strings, a forward set 18′ and a rearward set 18″, these two sets 18′ and 18″ both being parallel to the plane of the impact area of the frame 12 and spaced between the forward and rearward faces of the frame 12 (in the particular configuration herein, about one-half inch from each other). While only one of the sets 18′ or 18″ is necessary, by so providing two sets of strings 18′ 18″, the ball can be engaged by either face of the racket in a practice stroke.

In the particular arrangement shown herein, each set of strings 18′ and 18″ comprises four longitudinal strings 18*a* and two transverse strings 18*b*, arranged in a grid-like pattern so that the strings 18*a* and 18*b* divide the impact area of the racket 10 into a plurality of impact zones (specifically, fifteen impact zones arranged in three transverse rows of five each).

The string sets 18′ and 18″ and the barrier net 16 are mounted to the frame 12 by means of an auxiliary mounting frame 20, with the barrier net 16 being positioned between the two string sets 18′ and 18″. The particular auxiliary mounting frame shown herein, was constructed for an actual working prototype and is made from commonly available components. However, as indicated previously herein, it is to be understood that the specific construction of this auxiliary mounting frame 20 as well as other components would quite likely be modified for a racket that is manufactured on a large scale production basis.

The auxiliary mounting frame 20 is connected to the main racket frame 12 just inside the inner perimeter thereof. The auxiliary frame 20 is made up of a first outer rigid frame portion 22 and a resilient frame portion 24 mounted within the outer portion 22. For convenience of fabrication, assembly and adjustment, the rigid frame portion 22 is made up of four segments 22*a*, secured to the main racket frame 12 by means of a cord 26 which is strung through the existing holes in the racket frame 12 normally used for mounting the conventional strings of a playing racket.

The inner auxiliary frame portion 24 is made up of a moderately resilient material, such as rubber surgical hose, and is secured to the inside of the frame portion 22 at regularly spaced intervals (approximately an inch apart) along its entire length. A convenient way of accomplishing this is to wrap a cord 28 through the frame portions 22 and around the frame portion 24 in spiral fashion along the entire length thereof.

The retaining strings 18*a* and 18*b* are secured to the outer auxiliary frame portion 22. It will be noted that the longitudinal strings 18*a* are strung directly through the upper and lower frame segments 22*a*, and the transverse strings 18*b* are connected by their end portions to resilient cords 30, each of which is in turn connected to their related side frame segment 22*a*. The particular reason for this arrangement is to enhance the ability of these strings 18*a* and 18*b* to perform their function of deflecting to permit the ball to initially pass through the strings 18*a* and 18*b*, and then reliably retain the ball. In this particular arrangement of the retaining string means 18, the longtiudinal strings 18*a* are made of a resilient rubber-like material whose surface has a relatively high coefficient of friction. The transverse strings 18*b* are made of a relatively low friction material (e.g. Teflon), which is less resilient than the material of the longitudinal strings 18*a*. To permit the transverse strings 18*b* to deflect properly upon impact with the ball, their connection to the auxiliary frame portion 22 is made through these resilient cords 30.

It has been found that if both sets of strings 18*a* and 18*b* are made of a higher friction material, the ball is less able to pass through the strings 18*a* and 18*b*, and in some instances the ball when engaged will bounce away from the racket 10. However, by making the transverse strings 18*b* of a low friction material, the ball upon initial engagement is able to pass through the strings 18*a* and 18*b*. While this particular arrangement has been found to work effectively, it will be obvious to those skilled in the art that modifications could be made in this arrangement.

The barrier net 16 is made of a relatively light weight flexible net material. A suitable net material is a nylon material used in a conventional fish net for small game fish. If the net material is made too heavy, it provides unwanted resistance against the air during the racket stroke, and also tends to hang up on the retaining strings and provide more inertia in forming a pocket which creates more of a tendancy for the ball when engaged to rebound away from the racket 10.

The barrier net 16 is secured to the resilient frame portion 24 around the entire perimeter of the net 16 by a number of strands 32 placed about one inch apart. This resilient mounting 24 permits the net 16 to yield moderately upon impact with the ball, to reduce the force of initial impact, thus allowing the use of lighter net material to enhance the ball retaining function of the racket 10. The resilient mounting 24 will also prolong the life of the barrier net 24. An alternate means of mounting the net 16 is to attach it directly to the strings 18*a* and 18*b*.

Figure 5A:
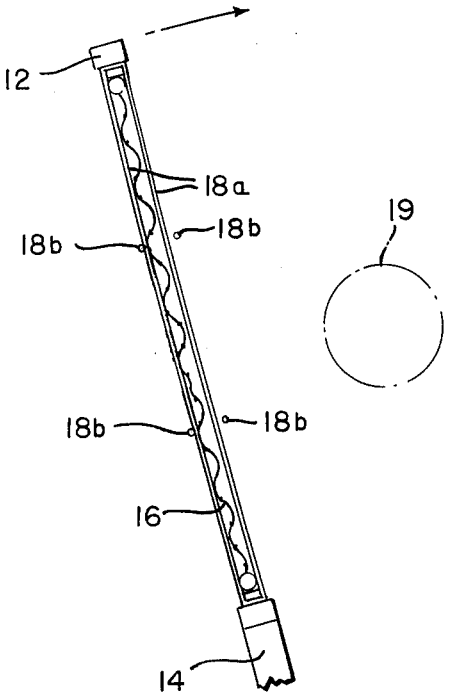
FIGS. 5A through 5D are four longitudinal sectional views illustrating the practice racket being swung through a service stroke, and illustrating particularly the manner in which the tennis ball is engaged and retained by the practice racket.
Figure 5B:
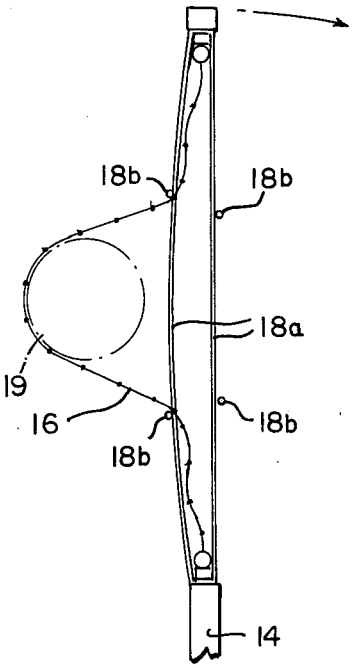

To describe the operation of the present invention, reference is now made to FIGS. 5A through 5D. As indicated previously, the normal serving motion in a game of tennis is for the player to toss the ball 19 into the air and then swing the racket 10 in an upward arc to engage the ball 19 as the racket 10 is passing through the uppermost paart of its arc. In FIG. 5A, the racket 10 is seen approaching the uppermost portion of its arcuate path of travel and is about to engage the ball 19. In FIG. 5B, the racket 10 is just passing beyond its uppermost arcuate portion of travel and has engaged the ball 19. The ball 19 has deflected the forward and rearward retaining strings 18*a* and 18*b* which it engages to the side and is engaging the barrier net 16, to carry it through the rearward retaining strings 18*a* and 18*b*. Since the area of the barrier net 16 is moderately greater than the total impact area within the racket frame 12, the barrier net 16 is able to deflect moderately in a rearward direction from the impact zone due to the force caused by engaging the ball 19.

Figure 5C:
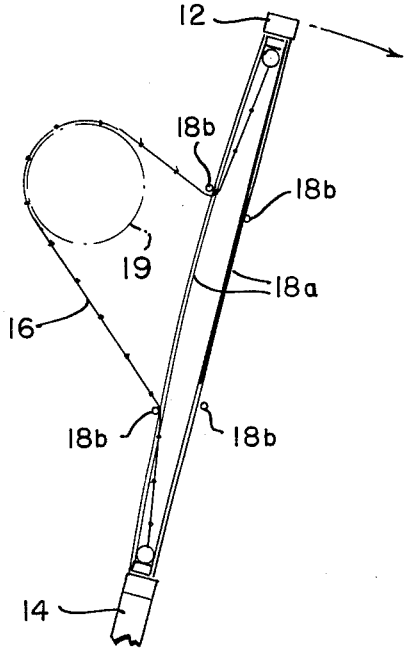
Figure 5D:
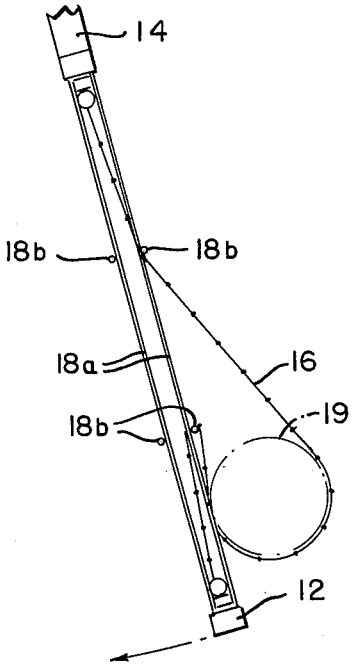

As the racket 10 continues through its arcuate path of travel with the ball 19 engaged in the net 16, there is an upward centrifugal force which tends to move the ball upwardly relative to the racket 10. This is illustrated in FIG. 5C, where it can be seen that the ball tends to pull the barrier net 16 toward the upper part of the racket 10 against the upper rear retaining string 18*b*. The ball remains in this same general position relative to the racket 10, until completion of the stroke. Upon completion of the stroke, the ball 19 remains in its retained position in the net 16 in the impact zone at which it entered the racket, as shown in FIG. 5D. The player is then able to simply pull the ball back through the retaining strings 18 in preparation for another practice stroke.

By observing which impact zone the ball entered during the service stroke, the player is able to determine if the ball is being engaged at the proper location of the impact area of the racket 10. In addition to permitting the coordinated action of tossing the ball 19 into the air and swinging the racket through a service stroke in one coordinated motion, the player is able to get the feel of impact with the ball 19. This is due to the fact that the ball 19, is being engaged by the barrier net 16 and retaining strings 18 just rearwardly of the plane of the impact area of the racket, exerts a rearward force on the racket 10.

What is claimed is:

1. A practice racket for a game such as tennis, by which a player executes a stroke against a game ball in a manner similar to a stroke executed with a conventional game racket in actual game play, while retaining the ball in the practice racket, said practice racket comprising:

a. a handle adapted to be grasped by the player to execute a stroke, b. a peripheral frame attached to the handle and defining therewithin the perimeter of an impact area generally in a plane occupied by the frame, said impact area corresponding to an area in the game racket where the ball is normally struck in game play, c. a flexible net means mounted to the frame and extending across said impact area, said net means being arranged to deflect at least moderately from the plane of the impact area upon engagement with a ball, and d. retaining string means connected to said frame and extending across said impact area, said string means being sufficiently yielding to permit the ball to pass therethrough and into the net means when the ball is engaged with the practice racket at said impact area, and said string means having sufficient tension to cooperate with the net means to form a retaining pocket to hold the ball in the net means after the ball has passed through the string means.

2. The racket as recited in claim 1, wherein said string means comprises a plurality of strings extending across said frame generally parallel to one another.

3. The racket as recited in claim 2, wherein said strings are arranged in two sets on opposite sides of the net.

4. The racket as recited in claim 1, wherein, said string means is arranged in a crisscross pattern defining a plurality of impact zones across the impact area.

5. the racket as recited in claim 4, wherein said strings are arranged in a crisscross pattern on both sides of the net.

6. The racket as recited in claim 1, wherein said net is attached to the frame by means of a resilient mounting to permit the net to yield upon impact with the ball.

7. The racket as recited in claim 1, wherein there is an auxiliary frame member to which at least one of the net means and string means is mounted.

8. The racket as recited in claim 7, wherein said auxiliary frame comprises resilient frame means.

9. The racket as recited in claim 1, wherein said string means comprises a low friction material having resilient end mounting means by which it is mounted to the racket.

10. The racket as recited in claim 1, wherein there is an auxiliary mounting frame means comprising at least in part resilient mounting means to which at least one of the net means and string means is attached, and said string means is arranged in a crisscross pattern on both sides of the net means to define a plurality of impact zones across the impact area of the net.

11. A practice racket for a game such as tennis, by which a player executes a stroke against a game ball in a manner similar to a stroke executed with a conventional game racket in actual game play, while retaining the ball in the practice racket, said practice racket comprising:

a. a handle adapted to be grasped by the player to execute a stroke, b. a peripheral frame attached to the handle and defining therewithin the perimeter of an impact area generally in a plane occupied by the frame, said impact area corresponding to an area in the game racket where the ball is normally struck in game play, c. a flexible net means mounted to the frame and extending across said impact area, said net means being arranged to deflect at least moderately from the plane of the impact area upon engagement with the ball, d. retaining string means connected to said frame and extending across said impact area, said string means being sufficiently yielding to permit the ball to pass therethrough and into the net means when the ball is engaged with the practice racket at said impact area, said string means having sufficient tension to cooperate with the net means to form a retaining pocket to hold the ball in the net means after the ball has passed through the string means, said string means being arranged in a generally crossing pattern to define a plurality of impact zones across the impact area of the net, said string means being arranged with said net means so that when the ball enters an impact zone it is retained in the net means in that impact zone.

12. The racket as recited in claim 11, wherein said string means are arranged in two sets on opposite sides of the net means.

13. The racket as recited in claim 11, wherein said string means comprises a low friction material having resilient mounting means by which it is mounted to the racket.

* * * * *